US012612868B1

(12) United States Patent
Hürlimann

(10) Patent No.: US 12,612,868 B1
(45) Date of Patent: Apr. 28, 2026

(54) THERMAL POWER PLANT WITH A GAS TURBINE, A HOT-AIR TURBINE AND A HEAT EXCHANGER FOR TRANSFERRING HEAT FROM THE GAS TURBINE TO THE HOT-AIR TURBINE

(71) Applicant: Hans P. Hürlimann, Herrliberg (CH)

(72) Inventor: Hans P. Hürlimann, Herrliberg (CH)

( * ) Notice: Subject to any disclaimer, the term of this patent is extended or adjusted under 35 U.S.C. 154(b) by 0 days.

(21) Appl. No.: 19/343,123

(22) Filed: Sep. 29, 2025

Related U.S. Application Data

(63) Continuation-in-part of application No. 19/201,072, filed on May 7, 2025.

(51) Int. Cl.
*F01K 23/10* (2006.01)
*F01K 25/10* (2006.01)

(52) U.S. Cl.
CPC ..... *F01K 23/10* (2013.01); *F01K 25/10* (2013.01)

(58) Field of Classification Search
CPC ..... F02C 1/06; F02C 1/10; F02C 6/18; F01K 23/10
See application file for complete search history.

(56) References Cited

U.S. PATENT DOCUMENTS

| | | | | |
|---|---|---|---|---|
| 5,442,904 | A | 8/1995 | Shnaid | |
| 5,782,081 | A * | 7/1998 | Pak | F02C 3/34 60/39.181 |
| 7,661,268 | B2 | 2/2010 | Althaus et al. | |
| 2004/0011047 | A1 | 1/2004 | Reissig | |
| 2022/0127009 | A1* | 4/2022 | Thomassin | F02B 37/00 |
| 2022/0389839 | A1* | 12/2022 | Bollinger | F01K 13/02 |
| 2024/0026824 | A1* | 1/2024 | Terwilliger | F02C 3/22 |
| 2024/0360788 | A1* | 10/2024 | Evans | F02C 3/22 |

FOREIGN PATENT DOCUMENTS

EP 1830052 A1 9/2007

* cited by examiner

*Primary Examiner* — Phutthiwat Wongwian
*Assistant Examiner* — Jacek Lisowski
(74) *Attorney, Agent, or Firm* — McCormick, Paulding & Huber PLLC

(57) ABSTRACT

The invention relates to a combined thermal power plant for generating electrical energy with a gas turbine and a hot-air turbine. The hot-air turbine comprises a closed gas circuit for conducting process gas. Heat is transferred from the exhaust gases of the gas turbine to the process gas of the hot air-turbine via a heat exchanger.

6 Claims, 3 Drawing Sheets

THERMAL POWER PLANT WITH A GAS TURBINE, A HOT-AIR TURBINE AND A HEAT EXCHANGER FOR TRANSFERRING HEAT FROM THE GAS TURBINE TO THE HOT-AIR TURBINE

CROSS-REFERENCE TO RELATED APPLICATIONS

This application is a continuation-in-part of U.S. patent application Ser. No. 19/201,072 filed May 7, 2025, which is hereby incorporated by reference in its entirety.

TECHNICAL FIELD

The invention relates to a thermal power plant according to claim 1.

BACKGROUND

Thermal power plants with a combination of a gas turbine and a steam turbine are known.

Furthermore, hot air turbines are known. Exemplarily, it is referred to the following literature:

Annals of Nuclear Energy, Volume 5, Number 1, 1978, Forty Years of Experience on Closed-Cycle Gas Turbines, C. Keller.

23rd Annual International ASME Gas Turbine Conference, London, 1978, The growing number of promsing applications for closed cycles, C. Keller.

Thiemig paperback 57, Munich, 1975, A general review of closed cycle gas turbines using fossil, nuclear and solar energy, K. Bammert.

ASME Paper 67-GT-10, Industrial closed cycle gas turbines for conventional and nuclear fuel, C Keller and P. Schmidt.

Hundreds of papers and technical articles have been written on various aspects of closed cycle gas turbines. The concept was patented by Ackeret and Keller in 1935. Many plants have been in operation for years and the technology of hot air turbines and closed cycle gas turbines are well established. The first Ackeret-Keller closed cycle plant was built at Escher Wyss in Zurich in 1939. Other well known closed cycle plants were established 1975 in Ravensburg, Germany and 1956 in Oberhausen, Germany.

SUMMARY

The invention relates to a combination of the cycles of a gas turbine (Rankine cycle) and a hot-air turbine with a closed cycle (Ackeret-Keller system/Ericsson cycle). This combination is defined as an advanced combined cycle. The advanced combined cycle achieves an even higher thermal efficiency than the familiar combination of a gas turbine and a steam turbine (CC-combined cycle). According to Carnot, this is due to the important possibility of using the waste heat from the gas turbine at a much higher temperature level with a hot-air turbine than with the steam boiler in a combination of a gas turbine and a steam turbine. The gas turbine and the hot-air turbine of the advanced combined cycle can also be operated independently of each other. This concept is economically significant.

We start with the Carnot Cycle. The highest thermodynamic efficiency can be achieved with a thermal cycle between two temperatures if both compression and expansion are isothermal. In the technical process, compression and expansion are adiabatic processes. In our opinion, the present invention is the best approximation to the ideal Carnot cycle proposed until today.

DETAILED DESCRIPTION

Figure 1:
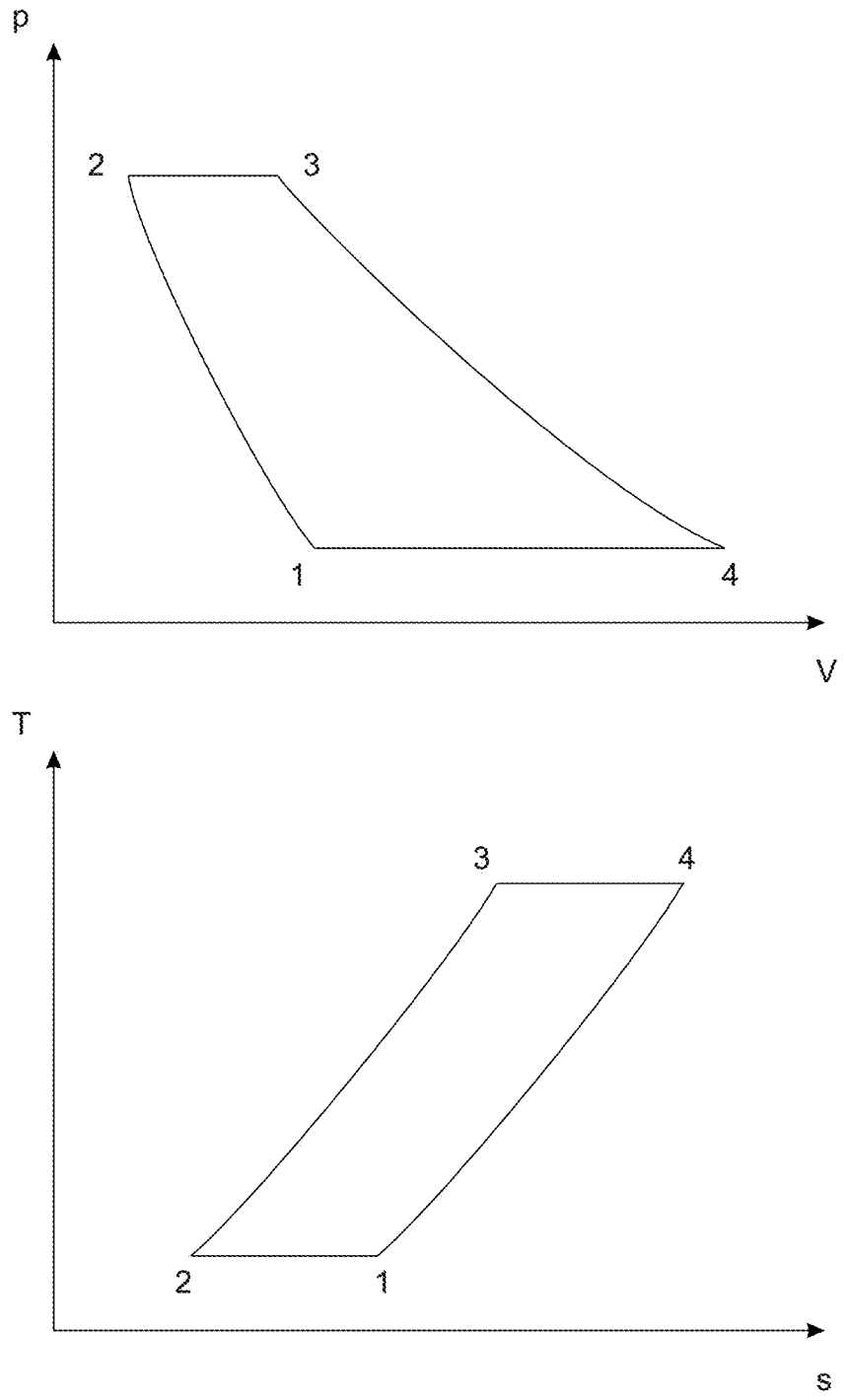
FIG. 1 shows an ideal Ackeret-Keller/Ericsson cycle in a p-V (pressure-volume) diagram and in a T-s (temperature-entropy) diagram.

The thermal power plant generates electrical energy. It comprises a gas turbine and a hot air turbine.

The gas turbine is familiar to persons skilled in the art. It is an combustion engine in which fuel is burned. The combustion generates a hot gas flow that can be used, for example, to generate rotational energy through a hot gas expansion turbine. The main components of a gas turbine, in the direction of flow, are the air inlet, the multi-stage compressor, which draws in and compresses air, the combustion chamber, in which the fuel is introduced and burned, a gas expansion turbine, which converts part of the energy from combustion into rotational energy, and the exhaust outlet. The compressor and turbine are arranged on a shaft. The turbine drives the compressor via the shaft. The principle is based on the Joule process.

The hot air turbine is based on the Ackeret-Keller cycle, also known as the Ericsson cycle. The hot air turbine is an aerodynamic heat engine with a closed cycle. The maximum theoretical efficiency according to the Carnot cycle corresponds to $$\eta=(T_h-T_t):T_h$$

where $T_h$ is the absolute high temperature of the existing heat source in Kelvin and $T_t$ is the absolute ambient temperature in Kelvin. This means that for a given ambient temperature, the efficiency depends on the temperature of the heat source. The hot-air turbine is a cycle in which the course of a any changes in condition is constant, i.e., the high temperature $T_h$ must be sufficiently low to ensure that the reliability of the material against temperature, pressure, centrifugal force, etc. is still sufficient.

If, for example, it is assumed that the ambient temperature is 300° K and the high temperature of the heat source is 1000° K, this results in a theoretical efficiency of 70%. This means that very high efficiencies can be achieved when working with temperatures that are common in furnaces, for example, as long as the deviations from the Carnot cycle can be minimized. Today, there are no machines that can realize the Carnot process.

The steam turbine cycle has come close to the Carnot cycle over a long period of development. Unfortunately, the evaporating pressures of the water at high temperatures are rather high and this necessitates the higher temperature $T_h$ of the Carnot Cycle being reduced to a considerable extent. The vapor cycle, which has the great advantage of machine-free compression, has its natural limits.

In the case of gases and particularly with air, no drawback of this kind exists, high temperatures being attainable without having to be accompanied by high pressures. Thus, the material employed for the construction of the plant can be subjected to high temperatures without inevitably having to be subjected to high pressures. This is achieved with a hot-air turbine using the Ackeret-Keller cycle, also known as the Ericsson cycle. The hot-air turbine was invented back in 1935. In contrast to an open gas turbine, in which air is burnt and exhaust gas is discharged, in the closed hot air turbine air is circulated, repeatedly compressed, the compressed air is heated via a first heat exchanger, expanded in the turbine, the excess heat can be released into the environment via a second heat exchanger and the circulation starts again with compressing the air. The heat source can be selected as required. For example, any fuel can be burnt outside the circuit and the heat can be transferred to the compressed air circulating in the circuit via a heat exchanger.

FIG. 1 shows an ideal Ackeret-Keller or Ericsson process. The Ackeret-Keller or Ericsson process undergoes two isobaric and two isothermal changes of state, whereby the amounts of heat absorbed or released during the isobaric compression or expansion are equal. The changes of state are: 1-2: isothermal compression, 2-3: heat supply at constant pressure in a heat exchanger, 3-4: isothermal expansion of heated air, 4-1: cooling at constant pressure. The Ackeret-Keller or Ericsson cycle is equivalent to the Carnot cycle, as heat is supplied to and dissipated from the outside at the same temperatures as in the Carnot cycle. The amount of heat which is released along 4-1 is returned to it along 2-3 by heat exchange in the circuit itself for heating.

In practice, isothermal compression and isothermal expansion is not possible. Isothermal changes are therefore achieved by multi-stage compression with intermediate cooling and multi-stage expansion with intermediate heating.

Figure 2:
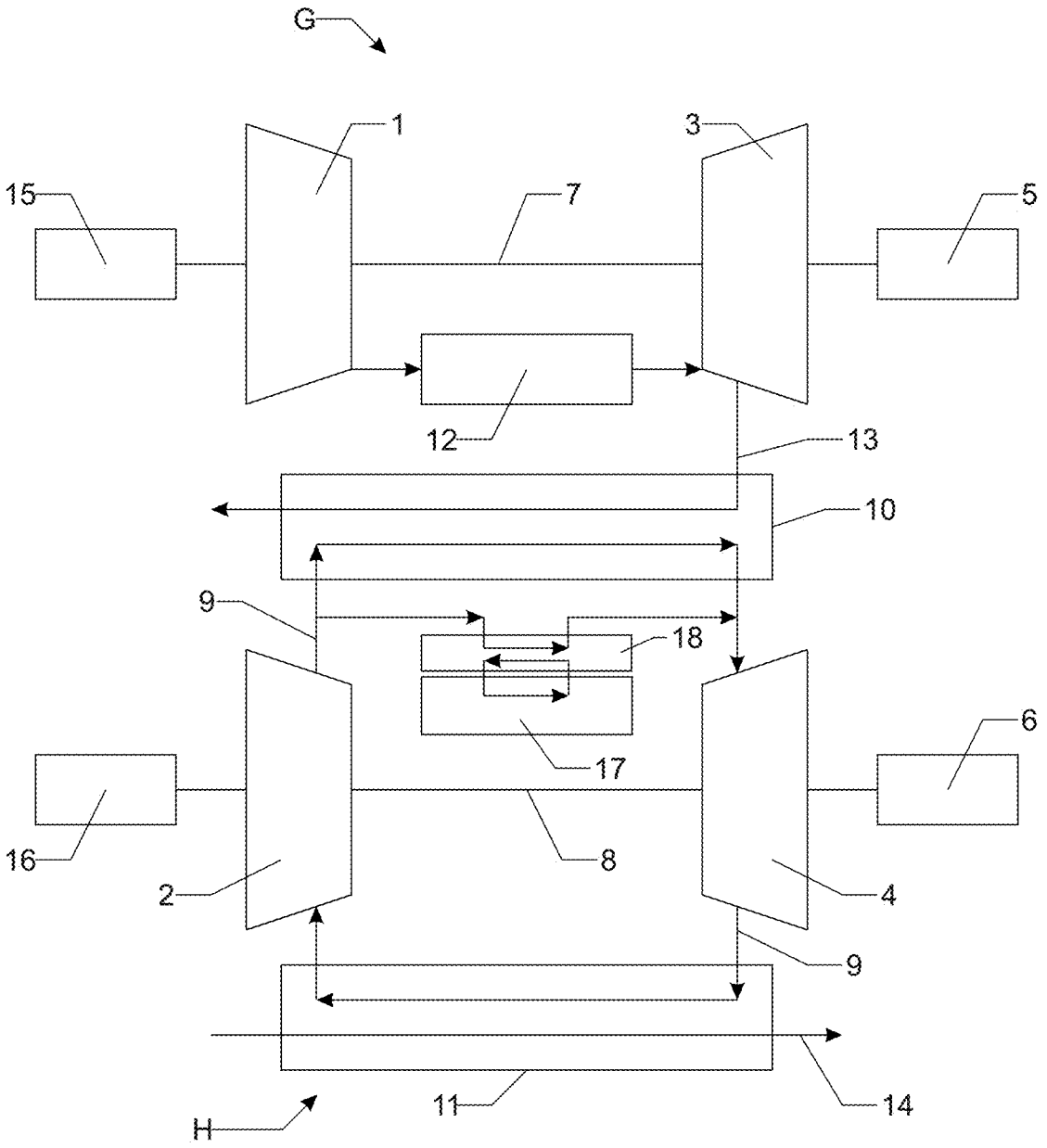
FIG. 2 below shows the arrangement of the various machine elements on which the invention is based.

The invention now consists of combining two known heat engines, namely the gas turbine and the hot-air turbine. The thermal energy from the exhaust gas of the gas turbine is transferred to the process gas of the hot-air turbine via a heat exchanger. The process gas is preferably air, but other gases can be used, like helium. FIG. 2 shows the machine parts of such a system. The machine parts of the combined system comprise the motor 15, the compressor 1, the turbine 3 and the generator 5 on the common shaft 7 of the gas turbine G. The motor 15 brings the gas turbine G up to operating speed during the start-up phase. Compressor 1 feeds the compressed fresh air to turbine 3 via combustion chamber 12. The turbine blades are made of steel with limited temperature resistance. If the temperature of the combustion gas at the turbine inlet exceeds this limit temperature, the turbine blades are kept in a safe range by an internal closed-circuit coolant.

The motor 16, the compressor 2, the turbine 4 and the generator 6 rotate on the common shaft 8 of the hot-air turbine H. The first heat exchanger 10 is integrated into the hot-air turbine H. It transfers heat from the exhaust gas flow 13 of the gas turbine G to the process air circulating in the closed circuit 9 of the hot-air turbine H in counterflow with a small temperature jump. The process gas circulates repeatedly through the compressor 2, the first heat exchanger 10, the turbine 4 the second heat exchanger 11 and back to the compressor 2 for the next cycle. Process gas is not exchanged with the environment, i.e., the same gas repeatedly circulates in the closed circuit, is repeatedly compressed, repeatedly heated up in the first heat exchanger, repeatedly expanded in the turbine and is repeatedly cooled down in the second heat exchanger.

The pipe system of the first heat exchanger 10 absorbs heat from the exhaust gas flow 13 of the gas turbine G on the outside on the surface covered with heat conducting fins and transfers it to the compressed process air of the closed circuit 9 of the hot-air turbine H with a small temperature jump. The second heat exchanger 11 cools the expanded hot air of the closed circuit 9 with a coolant 14 in counterflow to the lowest possible temperature.

The system can not only be used in combined operation. If the demand of electricity is low, the gas turbine can be deactivated and the hot-air turbine can be operated alone. For this, a combustion chamber 17 is provided. Any type of fuel can be burned inside the combustion chamber 17 using air from the environment. The heat generated by the combustion chamber 17 is transferred to the compressed air circulating in the closed circuit of the hot-air turbine via a third heat exchanger 18.

Figure 3:
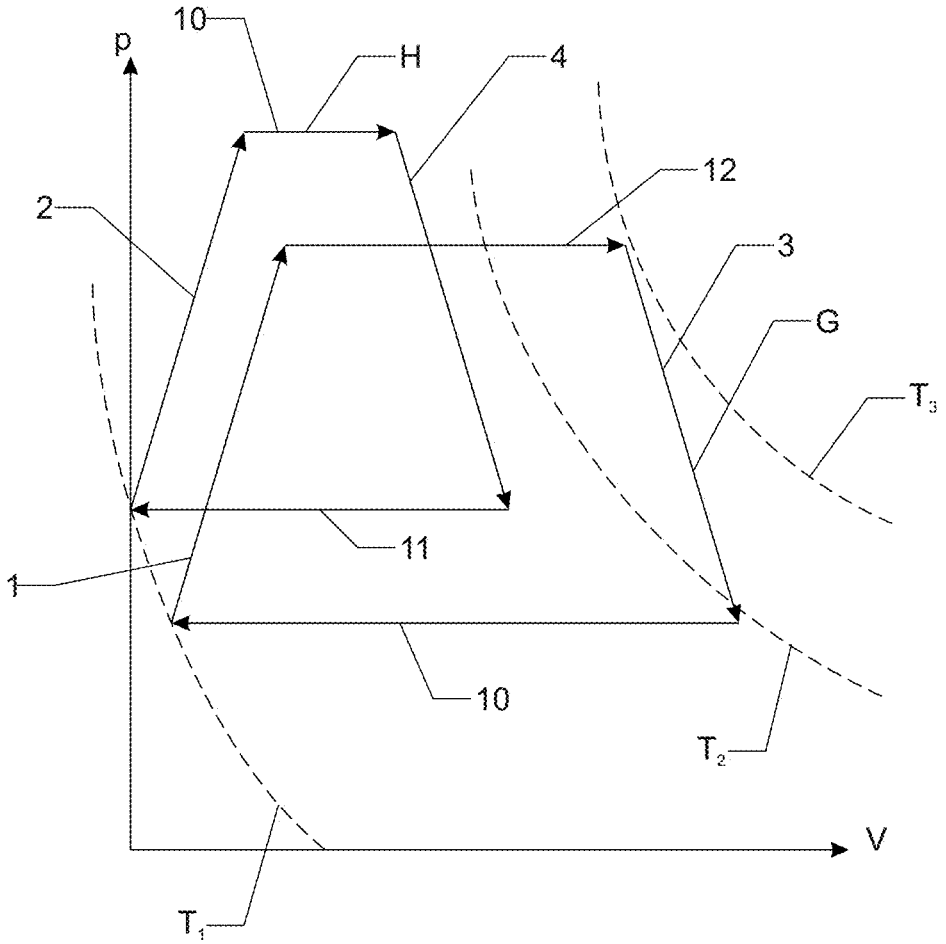
FIG. 3 shows the associated thermodynamic p-V (pressure-volume) diagram.

In FIG. 3, the combined thermodynamic p-V (pressure-volume) scheme with isothermal curves is sketched in the figure, where T1=300K, T2=1100K and T3=1750K. The machine elements are labelled with the numbers introduced above in FIG. 1. The adiabatic curves of the compressions and expansions are striking. The closed circuit 9 of the hot-air turbine is shifted towards higher pressure values in accordance with the externally raised pressure level of this closed circuit 9.

The following is a list of four additional advantages of the new system:

1. elimination of steam technology.
2. exclusive use of proven machine elements and materials.
3. the cooling gas circuit from the turbine blades can be connected to the temperature or pressure circuit of the hot-air turbine to improve the overall efficiency of the system.
4. the hot-air turbine can also be operated with a pressurised gas with a higher energy density and better convective heat conduction.

The invention claimed is:

1. A thermal power plant for generating electrical energy, comprising:

a gas turbine, a hot-air turbine with a closed circuit for circulating process gas repeatedly in the closed circuit, wherein the process gas is in gaseous form in the whole closed circuit, a first heat exchanger for transferring heat from an exhaust gas of the gas turbine to the process gas of the hot-air turbine, wherein the gas turbine comprises a first shaft, via which power can be transmitted from a turbine of the gas turbine to a first electrical generator, and the hot-air turbine comprises a second shaft, via which power can be transmitted from a turbine of the hot-air turbine to a second electrical generator.

2. The thermal power plant according to claim 1, wherein the hot-air turbine comprises a compressor and a turbine and the first heat exchanger is configured such that the heat is absorbed downstream of the compressor and upstream of the turbine in the closed circuit.

3. The thermal power plant according to claim 1, wherein the hot-air turbine has a second heat exchanger for releasing heat from the closed circuit to an environment.

4. The thermal power plant according to claim 1, wherein the gas turbine and the hot-air turbine can be operated separately from one another.

5. The thermal power plant according to claim 4, wherein heat is supplied from a combustion chamber to the process gas in the closed circuit during sole operation of the hot-air turbine.

6. The thermal power plant according to claim 1, wherein the process gas is process air, or helium.

* * * * *